US006543643B2

(12) United States Patent
Iida et al.

(10) Patent No.: US 6,543,643 B2
(45) Date of Patent: Apr. 8, 2003

(54) SHEET PACKAGE

(75) Inventors: Yukiko Iida, Kagawa (JP); Hiroki Ishikawa, Kagawa (JP)

(73) Assignee: Uni-Charm Corporation, Kawanoe (JP)

( * ) Notice: Subject to any disclaimer, the term of this patent is extended or adjusted under 35 U.S.C. 154(b) by 0 days.

(21) Appl. No.: 09/969,410

(22) Filed: Oct. 1, 2001

(65) Prior Publication Data

US 2002/0038805 A1 Apr. 4, 2002

(30) Foreign Application Priority Data

Oct. 4, 2000 (JP) ..... 2000-304626

(51) Int. Cl.[7] ..... A47K 10/24
(52) U.S. Cl. ..... 221/48; 206/449
(58) Field of Search ..... 221/33, 45, 46, 221/48, 34, 282, 63; 206/449, 812, 499, 545

(56) References Cited

U.S. PATENT DOCUMENTS 3,207,360 A 9/1965 Scott ..... 221/48

FOREIGN PATENT DOCUMENTS

| | | | |
|---|---|---|---|
| DE | 12475557 | 7/1967 | |
| EP | 0286538 | 10/1988 | ..... B65D/83/08 |
| EP | 0950615 | 10/1999 | ..... B65D/43/26 |
| EP | 0983739 | 3/2000 | ..... A47K/10/42 |

*Primary Examiner*—Kenneth W. Noland
(74) *Attorney, Agent, or Firm*—Darby & Darby

(57) ABSTRACT

Provided is a sheet package including a stack of sheets having a plurality of sheets folded about fold lines and arranged in a vertically stacked configuration, and a receptacle for containing the stack of sheets which is made of hard or soft material and has a dispensing opening in a top surface thereof. The stack of sheets includes an upper layer of a plurality of sheets located in the vicinity of the dispensing opening, and a lower layer of a plurality of sheets located under the upper layer. The width of the upper layer is smaller than that of the lower layer in a direction perpendicular to the fold lines of the sheets.

9 Claims, 7 Drawing Sheets

SHEET PACKAGE

BACKGROUND OF THE INVENTION

1. Field of the Invention

The present invention relates to a sheet package in which a stack of a plurality of folded sheets is packaged in a receptacle having a dispensing opening in such a manner as to continuously dispense the sheets.

2. Prior Art

Wet sheets are used for cleaning hands, for wiping babies' crotches or for wiping or cleaning toilets or kitchens. In order to maintain the sheets in a wet state, they are airtightly packaged in a container such as a hard case or a bag made of a package sheet. In this container, there is formed a dispensing opening for allowing the sheets to be sequentially taken out. The wet sheets of this type are stacked vertically one on top of the other in an interfolded manner. Accordingly, when an overlying sheet is withdrawn through the opening of the container, an underlying sheet is lifted and drawn to present an upper portion thereof in a readily accessible location above the opening.

FIG. 7 is an illustration of the conventional pop-up type of sheet package as set forth above.

In the sheet package shown in FIG. 7, a plurality of folded wet sheets 101 are stacked vertically one on top of the other in an interfolded manner. Each of these wet sheets 101 is folded in a Z-configuration to define a top flap portion 104 folded upward upon a central portion 103 and a bottom flap portion 102 folded downward under the central portion 103.

In the relationship between overlying and underlying wet sheets 101, the top flap portion 104 of the underlying sheet 101 lies between the bottom flap portion 102 and the central portion 103 of the overlying sheet 101. The bottom flap portion 102 of the overlying sheet and the top flap portion 104 of the underlying sheet are joined to each other with a water film over a range of a width of about 30 mm, for example.

The stack of wet sheets 101 is packaged in a receptacle or container 100 such as a hard case or a package bag having a dispensing opening 100*a* in a top surface thereof. As the top flap portion 104 of the overlying wet sheet 101 is grasped with the fingers of a user and is pulled out from the dispensing opening 100*a*, the underlying wet sheet 101 is dragged along with the overlying wet sheet. When the overlying wet sheet 101 is withdrawn, a portion of the top flap portion 104 of the underlying wet sheet 101 protrudes from the dispensing opening 100*a* to facilitate dispensing the next wet sheet 101.

In this sheet package of this type, however, the dispensing opening 100*a* has such a smaller width or opening size W11 than a width or as-folded width W10 of the wet sheet 101 as to increase the resistance applied to the wet sheet 101 by the periphery edge of the dispensing opening 100*a* upon dispensing the sheets. In particular, significantly high resistance is applied to the initial several wet sheets 101 which are located at the upper position of the stack of folded sheets.

Accordingly, the resistance is so significantly high to cause any inconvenience in taking out the initial several wet sheets. In recent years, on the other hand, the wet sheets have been exemplified by water-decomposable sheets which will be dispersed with large quantity of water when disposed of into a flush toilet after use. However, the water-decomposable wet sheets generally have wet breaking strength of 4.9 N or less for a width of 25 mm. Therefore, the water-decomposable wet sheets tend to be broken due to the resistance applied upon dispensing the sheets through the dispensing opening 100*a*.

In order to reduce the resistance to be applied by the peripheral edge of the dispensing opening 100*a* to the wet sheets, there can be conceived means for enlarging the width W11 of the dispensing opening 100*a* or reducing the width W10 of the wet sheets.

If the width W11 of the dispensing opening 110*a* is enlarged, however, the sheets packaged in the container 100 are easily dried. If the width W10 of the wet sheets is reduced, on the other hand, the height of the stack of the wet sheets is increased so that the container 100 becomes vertically elongated to cause any inconvenience in transporting and disposing the container for use.

Alternatively, if the number of sheets to be packaged in the container 100 is reduced relative to the capacity of the container 100 to leave a smaller clearance between the uppermost sheet and the dispensing opening, it is possible to reduce the resistance to be applied by the peripheral edge of the dispensing opening 100*a* when several uppermost sheets are to be taken out. In this case, however, the container 100 is excessively large in comparison with the size of the stack of folded sheets. In the case where the sheet package is formed of the package sheet, it is difficult to continuously automatically package the stack of folded sheets while leaving the clearance (or space) inside the container 100 upon enveloping the stacked sheets with the package sheet.

SUMMARY OF THE INVENTION

The present invention has been worked out in view of the shortcoming in the prior art set forth above. It is therefore an object of the present invention to provide a sheet package which allows sheets to be pulled out with a low resistance applied by the peripheral edge of a dispensing opening of a receptacle or a soft package bag without reducing the width (as-folded width) of a stack of folded sheets, without enlarging the width of the dispensing opening, and without leaving an excessive clearance within the receptacle or the soft package bag.

According to an aspect of the present invention, a sheet package comprising:

- a stack of sheets including a plurality of sheets folded about fold lines and arranged in a vertically stacked configuration;
- a receptacle for containing the stack of sheets, the receptacle made of hard or soft material and having a dispensing opening in a top surface thereof;
- the stack of sheets including an upper layer of a plurality of sheets located in the vicinity of the dispensing opening, and a lower layer of a plurality of sheets located under the upper layer; and
- the width of the upper layer being smaller than that of the lower layer in a direction perpendicular to the fold lines of the sheets.

For example, on the other hand, the width of the upper layer is substantially equal to the width of the lower layer in a direction parallel to the fold lines.

Furthermore, the clearances are left on both sides of the upper layer within the receptacle.

In the structure of the invention set forth above, the width of the upper layer of the stack of sheets is small so that the low resistance is applied by the peripheral edge of the dispensing opening to the sheets upon taking out the sheets of the upper layer. When the sheets of the lower layer are taken out, on the other hand, a clearance (or space) is left between the sheets of the lower layer and the dispensing opening so that the sheets can be taken out with the low resistance.

For example, the individual sheets are wet sheets moistened with water or a solution. The invention is especially effective in water-decomposable sheets having wet breaking strength of 4.9 N or less per a width of 25 mm in the direction perpendicular to the fold lines of the sheets.

The resistance applied to the sheets upon being pulled out is low enough to prevent the sheets from being broken even if the sheets are water-decomposable sheets having low breaking strength.

The sheets of the invention may be either water-undecomposable wet sheets or dry sheets containing no moisture. In the case of employing these sheets, the resistance to be applied by the peripheral edge of the dispensing opening can be also reduced upon taking out the sheets to be effective in easily withdrawing the sheets.

For example, the individual sheets are folded to define a top flap portion and a bottom flap portion, and interfolded in such a manner that the top flap portion of an underlying sheet lies on the bottom flap portion of an overlying sheet so as to protrude a portion of the underlying sheet from the dispensing opening when the overlying sheet is withdrawn.

In the invention, however, the top and bottom portions of the overlying and underlying sheets may not be overlapped and joined via an overlap portion so that a portion of the underlying sheet is not protruded from the dispensing opening when the overlying sheet is withdrawn.

On the other hand, the number of times of folding the sheets located in the upper layer may be larger than the number of times of folding the sheets located in the lower layer.

It is preferable that the number of the sheets of the upper layer is not less than two, and is also one half or less of a total of the sheets of the upper layer and the lower layer. More preferably, the width of the upper layer is 40 to 90% of the width of the lower layer in the direction perpendicular to the fold lines of the sheets.

BRIEF DESCRIPTION OF THE DRAWINGS

The present invention will be understood more fully from the detailed description given hereinafter and from the accompanying drawings of the preferred embodiment of the present invention, which, however, should not be taken to be limitative to the invention, but are for explanation and understanding only.

In the drawings.

DESCRIPTION OF THE PREFERRED EMBODIMENT

The present invention will be discussed hereinafter in detail in terms of the preferred embodiment of a sheet package according to the present invention with reference to the accompanying drawings. In the following description, numerous specific details are set forth in order to provide a thorough understanding of the present invention. It will be obvious, however, to those skilled in the art that the present invention may be practiced without these specific details. In other instance, well-known structure is not shown in detail in order to avoid unnecessary obscurity of the present invention.

Firstly, a first embodiment of a sheet package of the invention will be described in detail hereinafter.

FIGS. 1A, 1B, 1C and 1D are perspective views showing how to fold upper sheets of a stack of folded sheets; FIGS. 2A, 2B and 2C are perspective views showing how to fold lower sheets of a stack of folded sheets; and FIG. 3 is a sectional view showing a stack of folded sheets in which the individual sheets are combined (or interfolded).

Figure 3:
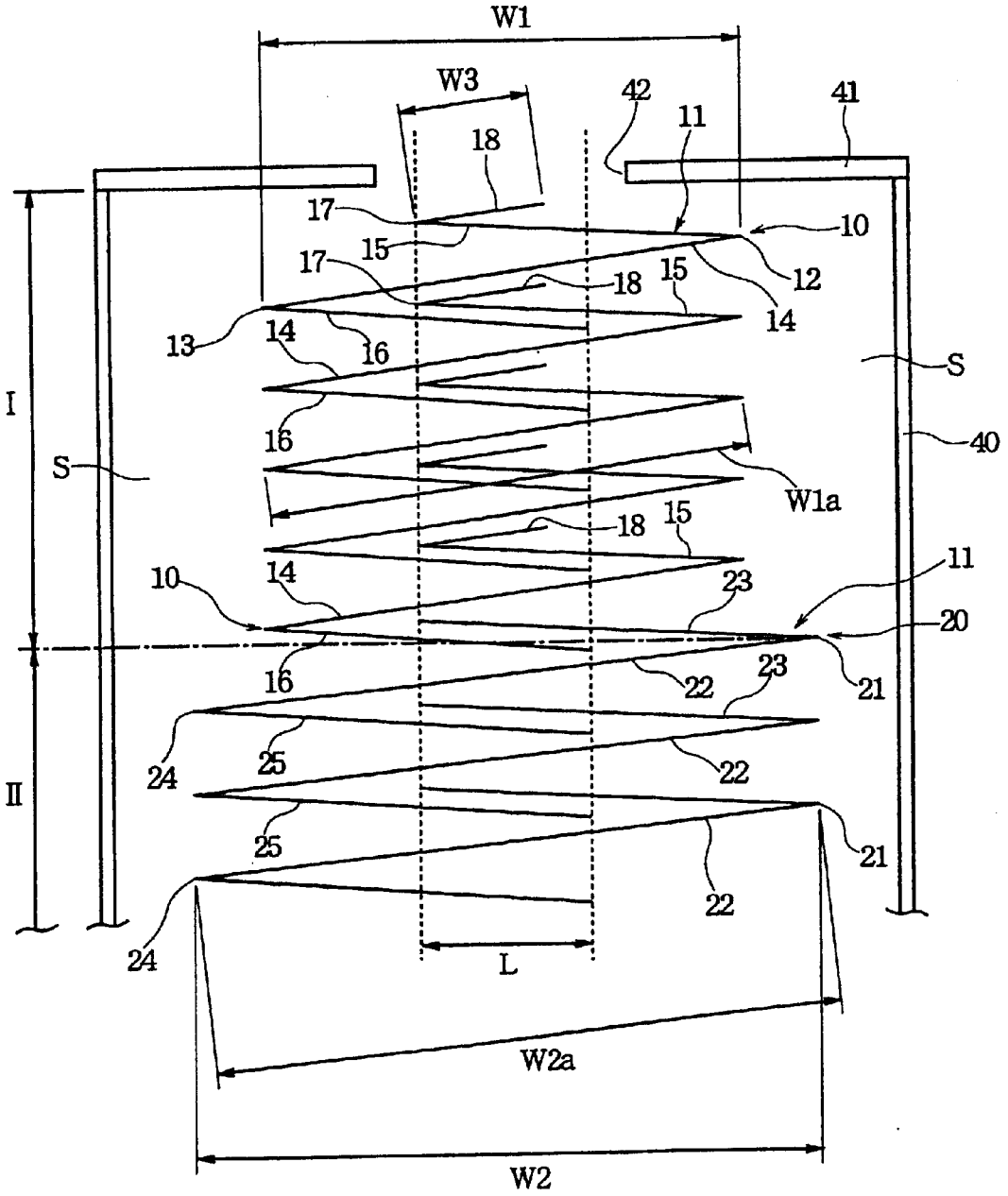
FIG. 3 is a sectional view showing the state in which a stack of folded sheets of FIGS. 1 and 2 is packaged in a container.

As shown in FIG. 3, the stack of folded sheets to be packaged in a container or receptacle 40 includes an upper layer I composed of a plurality of folded sheets 10, and a lower layer II composed of a plurality of folded sheets 20. The upper layer I has a smaller width W1 than the width W2 of the lower layer II. As a result, smaller clearances (or spaces) S are left on both right and left sides of the upper layer I and over the lower layer II within the container 40.

In the shown embodiment, the width W1 of the upper layer I of the stack of sheets is substantially equal to the width W1*a* (i.e., the distance between fold lines 12 and 13) of a central portion 14 of each folded sheet 10 composing the upper layer I. On the other hand, the width W2 of the lower layer II of the stack of sheets is substantially equal to the width W2*a* (i.e., the distance between fold lines 21 and 24) of a central portion 22 of each folded sheet 20 composing the lower layer II.

In this shown embodiment, the difference between the widths W1 and W2 is defined by making the number of times of folding the sheets lying in the upper layer I more than the number of times of folding the sheets lying in the lower layer II. (i.e., the sheets lying in the upper layer I are folded in a W-configuration, and the sheets lying in the lower layer II are folded in a Z-configuration.)

Figure 1A:
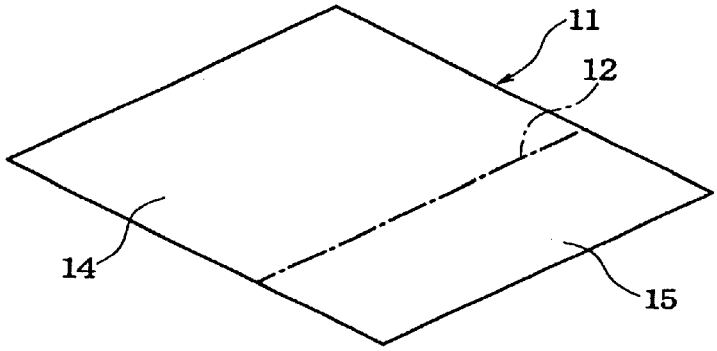
FIGS. 1A, 1B, 1C and 1D are perspective views showing how to fold sheets of an upper layer in a sheet package according to a first embodiment of the invention.
Figure 1B:
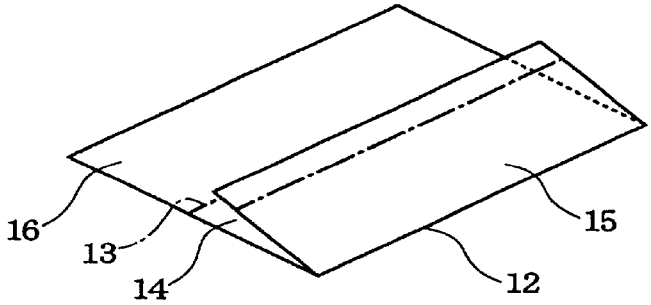
Figure 1C:
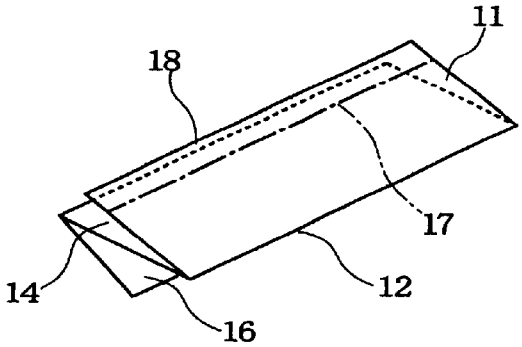
Figure 1D:
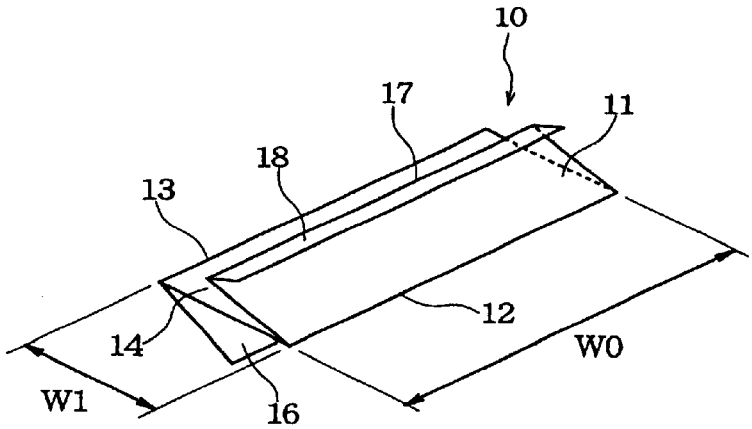
Figure 2A:
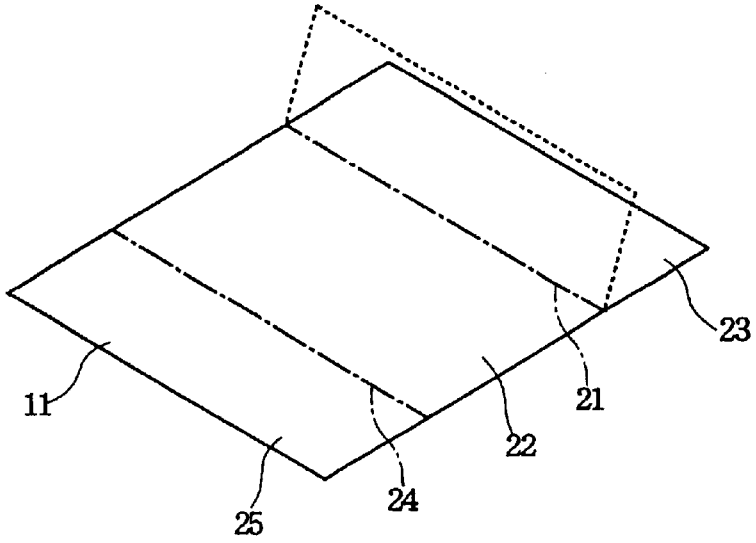
FIGS. 2A, 2B and 2C are perspective views showing how to fold sheets of a lower layer according to the first embodiment of the invention.
Figure 2B:
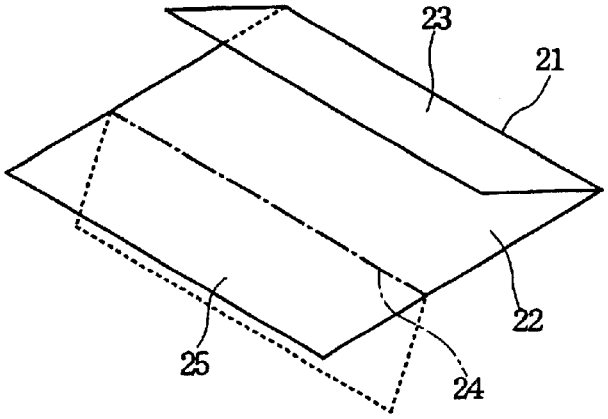
Figure 2C:
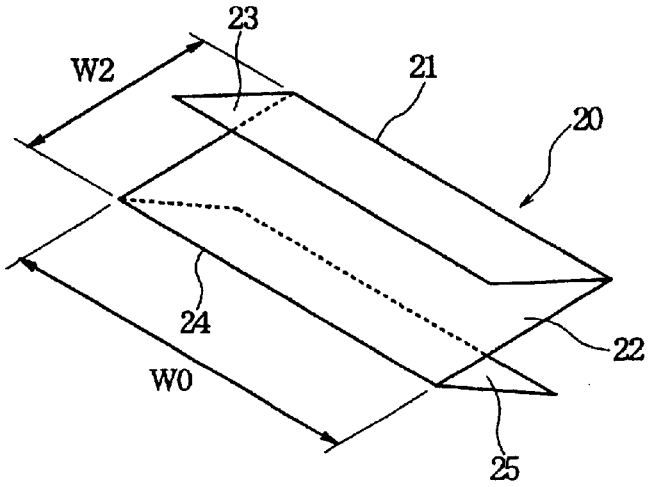

With the folding structure of the folded sheets 10 lying in the upper layer I, an unfolded sheet 11 having a rectangular shape is folded upward about the fold line 12 parallel to each shorter side of the unfolded sheet 11 (as shown in FIG. 1A) to define a top flap portion 15 upon a central portion 14 (as shown in FIG. 1B), and is folded downward about the fold line 13 similarly parallel to each shorter side of the unfolded sheet 11 to define a bottom flap portion 16 under the central portion 14 (as shown in FIG. 1C). Furthermore, a tip end portion of the top flap portion 15 is folded upward about a fold line 17 parallel to the fold lines 12 and 13 to define a turn-up portion 18 (as shown in FIG. ID).

With the folding structure of the folded sheets 20 lying in the lower layer II, an unfolded sheet 11 having a rectangular shape is also folded in a similar manner to the case with the upper layer I. Specifically, as shown in FIG. 2A, a top flap portion 23 is folded upward about the fold line 21 parallel to each shorter side of the unfolded sheet 11 upon the central portion 22 (as shown in FIG. 2B), and a bottom flap portion 25 is folded downward about the fold line 24 parallel to each shorter side of the unfolded sheet 11 under the central portion 22 (as shown in FIG. 2C).

In the upper layer I of the stack of sheets, the top flap portion 15 and the turn-up portion 18 of the underlying sheet 10 lie between the central portion 14 and the bottom flap portion 16 of the overlying sheet 10, as shown in FIG. 3. In the shown embodiment, the bottom flap portion 16 of the overlying sheet and the top flap portion 15 of the underlying sheet are overlapped via an overlap portion L. In the case where the individual sheets are moistened with water or chemicals, the sheets are airtightly contact with each other via water films on the overlap portion. In the case where the sheets are dry, on the other hand, the bottom flap portion 16 of the overlying sheet and the top flap portion 15 of the underlying sheet are joined into the frictional engagement (i.e., with the frictional force of the sheet surfaces).

In the lower layer II of the stack of sheets, the top flap portion 23 of the underlying sheet 20 lies between between the central portion 22 and the bottom flap portion 25 of the overlying sheet 20. The top flap portion 23 of the underlying sheet 20 and the bottom flap portion 25 of the overlying sheet 20 are overlapped via the overlap portion L.

At the boundary between the upper layer I and the lower layer II, the top flap portion 23 of the underlying sheet 20 lies between the central portion 14 and the bottom flap portion 16 of the overlying sheet 10. The top flap portion 23 of the underlying sheet 20 overlaps on the bottom flap portion 16 of the overlying sheet 10 via the overlap portion L.

Thus, the overlap portion between the folded sheets 10 in the upper layer I, the overlap portion between the folded sheets 20 in the lower layer II, and the overlap portion between the folded sheet 10 and the folded sheet 20 at the boundary between the upper layer I and the lower layer II, have the same width (or distance).

In the case of the wet sheets, the width of the overlap portion L is preferred to be 30±20 mm or more preferred to be 30±10 mm so that the underlying sheet can be lifted and drawn to present an upper portion thereof in a readily accessible location above the opening when the overlying sheet is withdrawn.

With the folded sheet 10 of the upper layer I, the tip end portion of the top flap portion 15 is folded about the fold line 17 to define the turn-up portion 18, and the top flap portion 15 having the turn-up portion 18 overlaps on the bottom flap portion 16 of the overlying sheet 10 via the overlap portion L. Thus, all the sheets are joined to each other via the overlap portion L having the same width. Accordingly, the width (W1) of the folded sheet 10 is shorter than the width (W2) of the folded sheet 20 due to provision of the turn-up portion 18.

In other words, the folded sheets 10 of the upper layer I and the folded sheets 20 of the lower layer II are defined by folding the rectangular unfolded sheets 11 having the same size, but the number of times of folding each sheet about the fold lines parallel to both shorter sides of the unfolded sheet is larger in the folded sheets 10 of the upper layer I than in the folded sheets 20 of the lower layer II. Furthermore, the width of each overlap portion L between the folded sheets of the upper and lower layers I and II is equal as set forth above.

Therefore, if the turn-up portion 18 has the width W3, the difference (W2*a*−W1*a*) between the width W2*a* (substantially equal to W2) of the central portion 22 of the folded sheet 20 and the width W1*a* (substantially equal to W1) of the central portion 14 of the folded sheet 10 is expressed by W2*a*−W1*a* =W3×(½). For W3=20 mm and W2*a*=80 mm (i.e., if W3 is 20 mm and W2*a* is 80 mm), for example, the width W1*a* is 70 mm.

It is preferred that the width W1 (W1*a*) is 40 to 90% of the width W2 (W2*a*). On the other hand, if the direction perpendicular to the fold lines of the sheets is referred to as a first direction and the direction perpendicular to the first direction (i.e., the direction parallel to the fold lines of the sheets) is referred to as a second direction, the folded sheets 10 and the folded sheets 20 have the same width W0 in the second direction of FIG. 3 (the width W0 is also referred to as an unfolded length).

On the other hand, the upper layer I comprises at least two folded sheets, preferably three folded sheets or more, or more preferably five folded sheets or more. However, each folded sheet 10 has a larger thickness due to provision of the turn-up portion 18. If the number of folded sheets 10 of the upper layer I is excessively large, therefore, the height of the stack of folded sheets per se is increased. Accordingly, the upper layer I preferably comprises ten folded sheets or less, or the ratio of the number of the folded sheets 10 of the upper layer I to the sum of the number of the folded sheets 10 of the upper layer I and the number of the folded sheets 20 of the lower layer II is preferably one half or less, or more preferably one third or less.

The stack of sheets composed of the upper layer I and the lower layer II is packaged in the container 40. This container 40 may be a hard plastic case or a bag made of a package sheet such as a film. In a top surface 41 of the container 40 such as the hard case or the bag, there is formed a dispensing opening 42.

Alternatively, the stack of sheets may be packaged in the bag made of the soft package sheet and having the dispensing opening, and further packaged for use in the hard case having the dispensing opening.

The stack of sheets composed of the individual folded sheets 10 and 20 is packaged in the container 40 without leaving any clearance (or space) between the top surface of the container and the uppermost sheet of the stack of sheets, and between a bottom surface of the container and the lowermost sheet of the stack of sheets. As set forth above, however, smaller clearances (or spaces) S are left on both left and right sides of the upper layer I and over the lower layer II.

Figure 4:
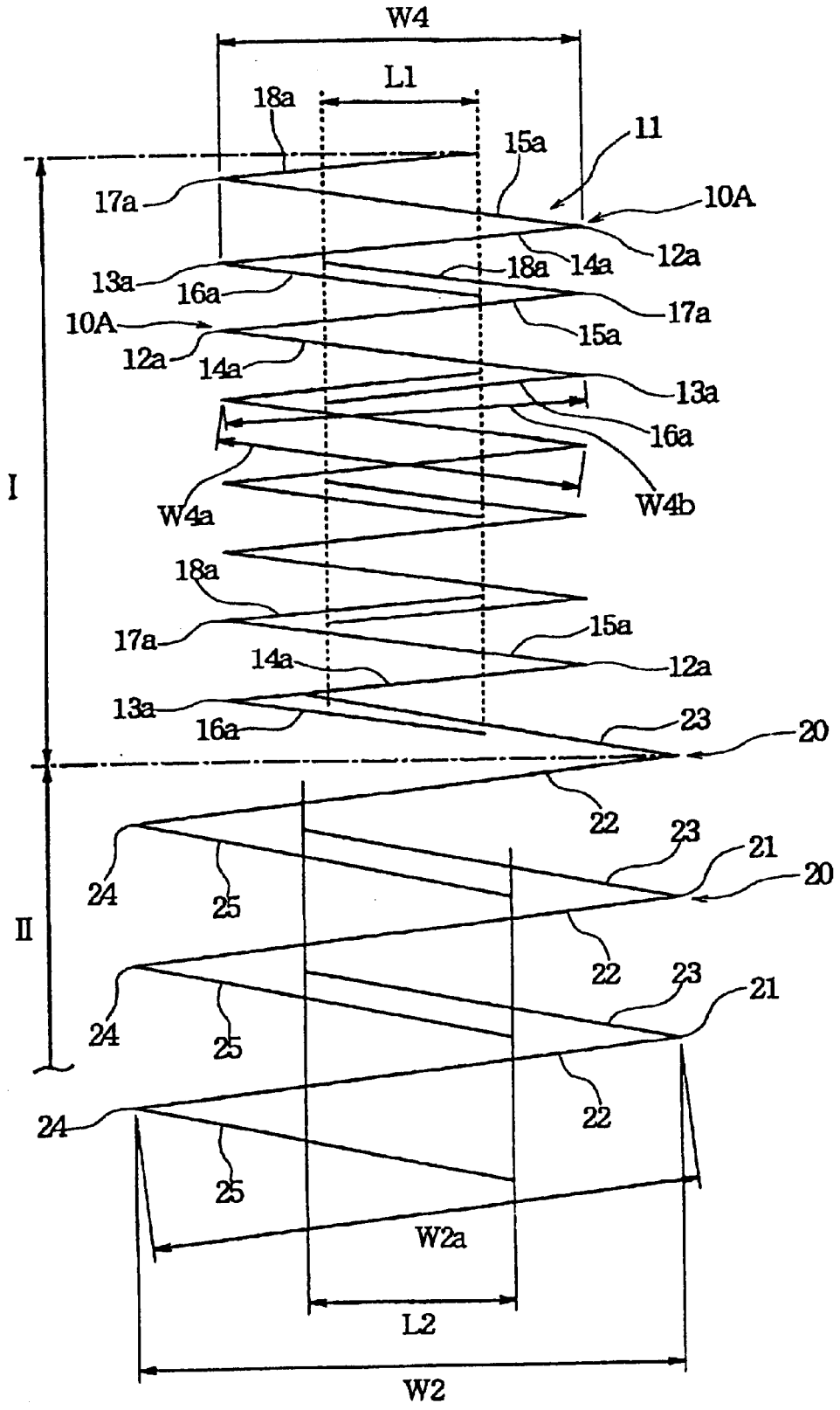
FIG. 4 is a sectional view showing an alternative embodiment of the first embodiment according to the invention.

FIG. 4 is an illustration of an alternative embodiment of the first embodiment set forth above.

In the alternative embodiment shown in FIG. 4, the structure of the folded sheets 20 of the lower layer II is identical to that shown in FIGS. 2 and 3.

On the other hand, folded sheets 10A of the upper layer I are formed by folding the rectangular unfolded sheets 11 having the same sizes as those of the folded sheets 10 shown in FIGS. 1 and 3. The folding structure of the folded sheets 10A is similar to that of the folded sheets 10, but each size of the individual folded portions of the folded sheets 10A is different from that of the folded sheets 10.

With the folded sheet 10A of the upper layer I, as shown in FIG. 4, each sheet is folded into two about a fold line 12*a* to define two central portions 14*a* and 15*a* each having an equal width W4*a*. Then, a bottom flap portion 16*a* is folded downward about a fold line 13*a* under a lower central portion 14*a*. On the other hand, a top flap portion 18*a* is folded upward about a fold line 17*a* upon an upper central portion 15*a*. The folded sheets are arranged alternately in W and reverse W configurations to define the folded sheets 10A (i.e., the sheets are symmetrically combined with each other).

Specifically, the top flap portion 18*a* of the underlying sheet lies between the lower central portion 14*a* and the bottom flap portion 16*a* of the overlying sheet such that the bottom flap portion 16*a* and the top flap portion 18*a* are overlapped via an overlap portion L1. At the boundary between the upper layer I and the lower layer II, on the other hand, the top flap portion 23 of the folded sheet 20 lies on the bottom flap portion 16*a* of the folded sheet 10A.

If both longer sides of the unfolded sheet 11 have a size of 190 mm, if two central portions 14*a* and 15*a* have the width W4*a* (i.e., the width W4 of the upper layer I) of 55 mm, and the bottom flap portion 16*a* and the top flap portion 18*a* have an equal width, both the bottom flap portion 16*a* and the top flap portion 18*a* have a width of 40 mm. If the individual folded sheets 10A are so interfolded (or combined) that the width W4*a* of two central portions 14*a* and 15*a* may be equal to the width W4 of the upper layer I, the overlap portion L1 has a width of 25 mm.

It is also possible to vary an interfolded (or combined) width W4*b* of the top flap portion 18*a* and the bottom flap portion 16*a* of the folded sheet 10A. If this interfolded width W4*b* is set to W4*a* −5 mm, the width of the overlap portion L1 can be set to 30 mm which is the most preferable interfolded width of the wet sheets. In this case, the width W4 of the upper layer I is calculated by W4*a* +5 mm=60 mm.

On the other hand, if the folded sheets 20 of the lower layer II are also formed by folding the sheets 11 having the length of 190 mm, and if the individual folded sheets 20 are so interfolded (or combined) that the width W2*a* of the central portion 22 may be equal to the width W2 of the lower layer II, the width of an overlap portion L2 is 30 mm for W2*a* (=W2) of 80 mm (i.e., if W2*a* is 80 mm).

By interfolding (or combining) the folded sheets as set forth above, it is possible to set the width W2 of the lower layer II to 80 mm and to set the width W4 of the upper layer I to 55 mm or 60 mm.

The stack of folded sheets of FIG. 4 is also packaged in the container 40 similar to that shown in FIG. 3.

Figure 5:
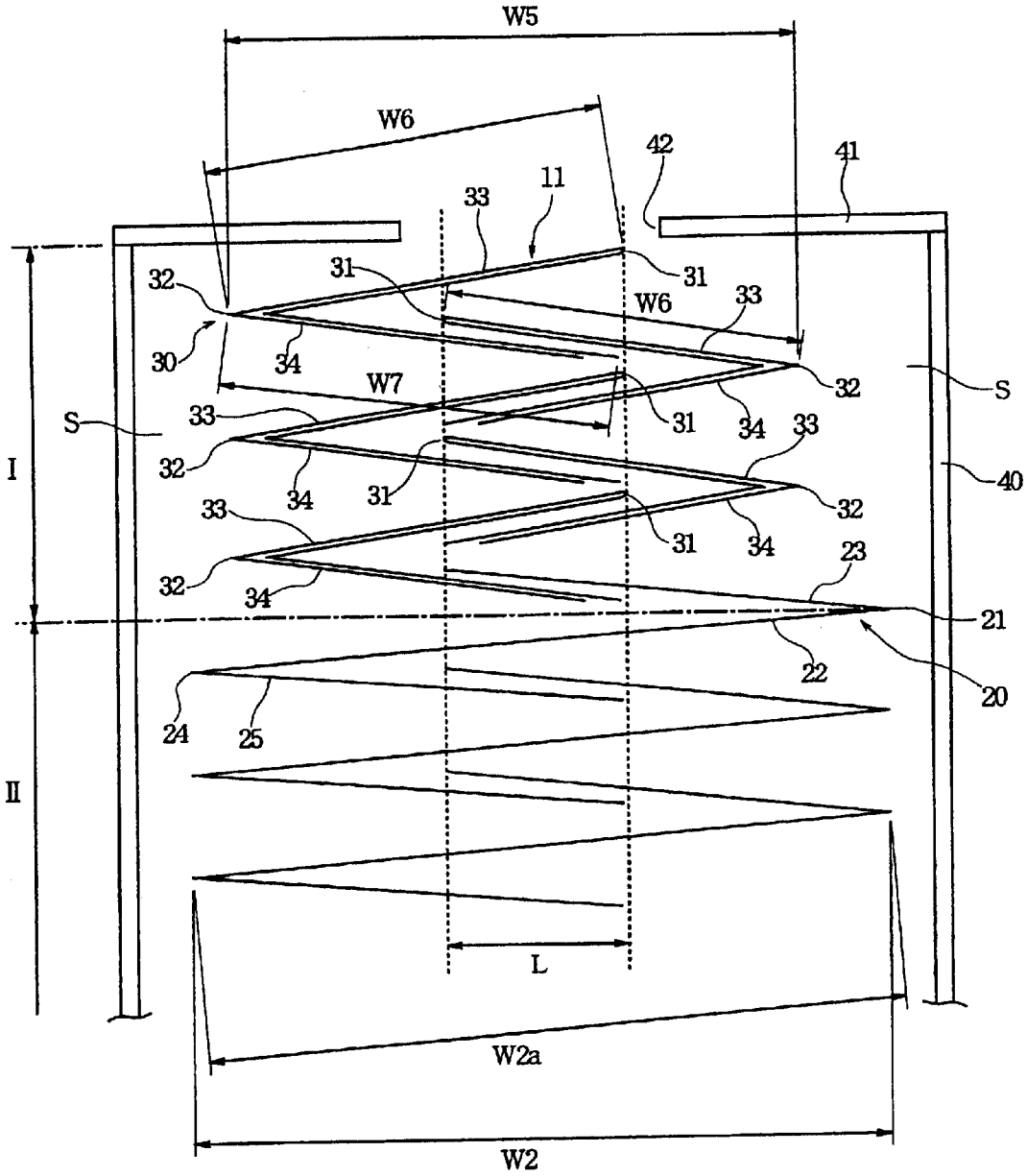
FIG. 5 is a sectional view showing a second embodiment of a sheet package according to the invention.

FIG. 5 is an illustration of a second embodiment of a sheet package according to the invention.

In the shown embodiment of FIG. 5, the upper layer I of the stack of sheets to be packaged in the container 40 has a width W5 which is defined by combination of two folded sheets 30. The sheets of folded sheets 30 are arranged alternately in V and reverse V configurations. On the other hand, the folded sheets 20 composing the lower layer II are arranged in a Z-folded configuration as is the case with the first embodiment shown in FIG. 3. Specifically, the top flap portion 23 is folded upward about the fold line 21 parallel to each shorter side of the unfolded sheet upon the central portion 22, and the bottom flap portion 25 is folded downward about the fold line 24 parallel to each shorter side under the central portion 22. Therefore, the lower layer II has the width W2 substantially equal to the width W2*a* of the central portion 22.

Figure 6A:
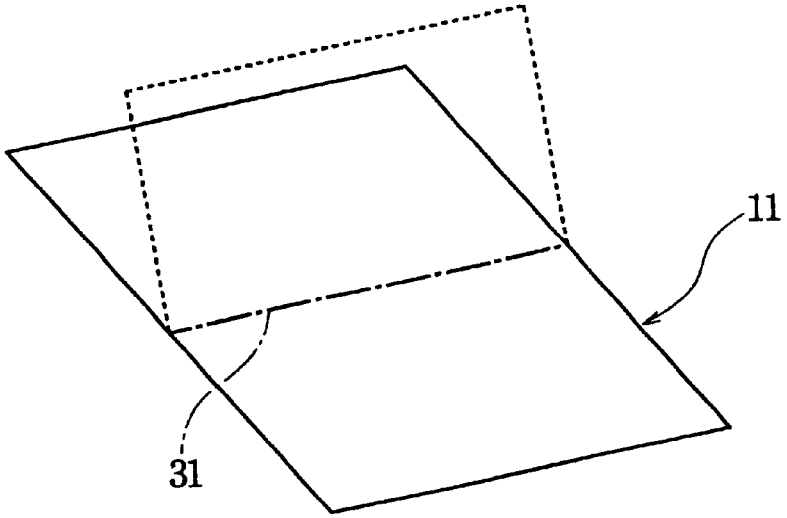
FIGS. 6A, 6B and 6C are perspective views showing how to fold sheets of an upper layer in the sheet package according to the second embodiment of FIG. 5.
Figure 6B:
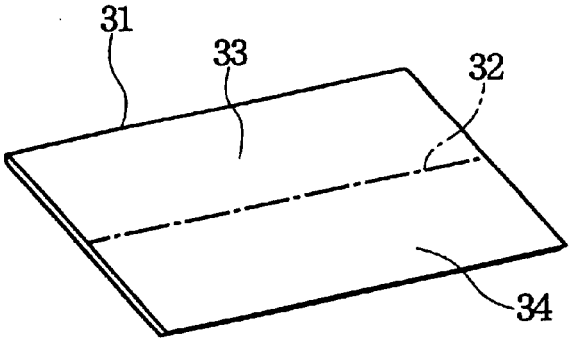
Figure 6C:
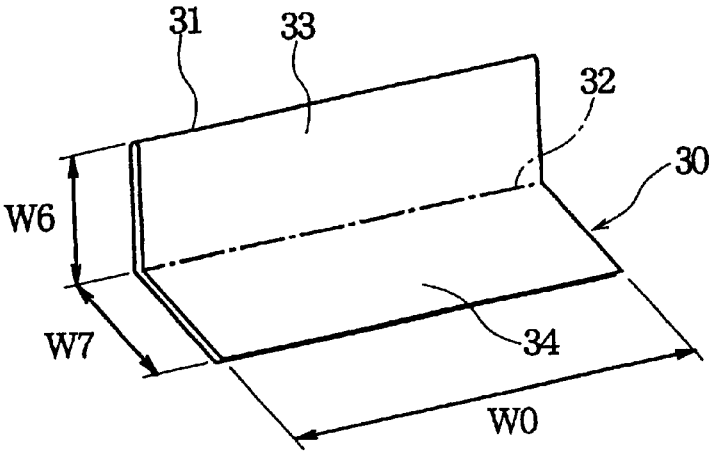
Figure 7:
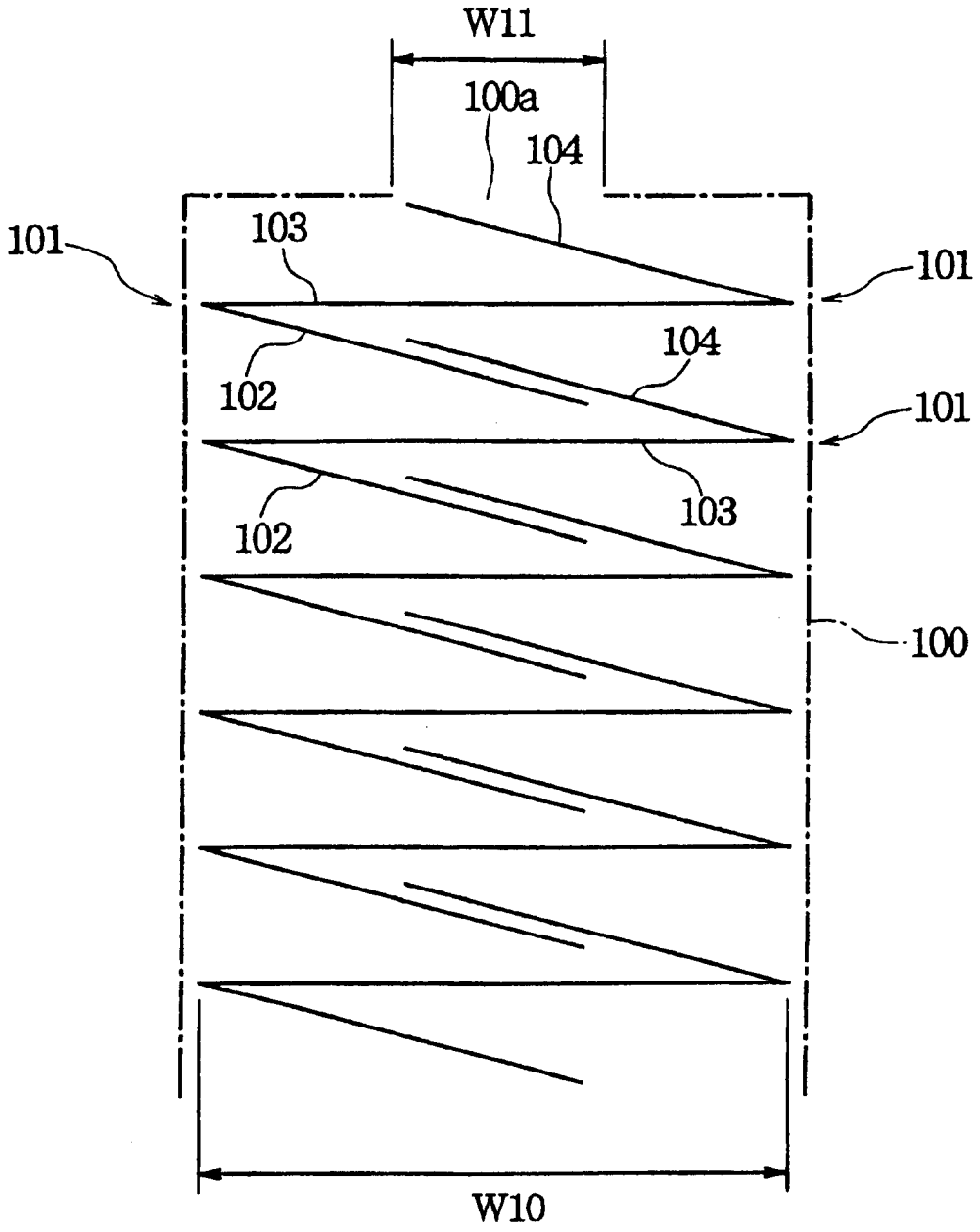
FIG. 7 is a sectional view of the conventional sheet package.

The folded sheets 30 of the upper layer I are formed by folding the rectangular unfolded sheets 11 of the same sizes as those used in FIG. 3. As shown in FIGS. 6A and 6B, the sheet 11 is folded into two about a fold line 31 parallel to each shorter side of the unfolded sheet to form two halves each having substantially the same area. As shown in FIG. 6C, the two-folded sheet is further folded into two about a fold line 32 parallel to each shorter side of the unfolded sheet to define a two-folded (or double) top flap portion 33 and a two-folded (or double) bottom flap portion 34.

With the upper layer I of the shown embodiment in FIG. 5, the top flap portion 33 of the underlying sheet 30 lies on the bottom flap portion 34 of the overlying sheet 30 so that the bottom flap portion 34 and the top flap portion 33 are overlapped via the overlap portion L. The width W5 of the upper layer I is defined by combination of two folded sheets 30, and expressed by (W6+W7)−L for the width W6 of the top flap portion 33 and the width W7 of the bottom flap portion 34. For example, if the width W6 is 45 mm and the W7 is 50 mm, and the width of the overlap portion L is 30 mm, the width W5 is exemplified by 65 mm. On the other hand, the width W2 of the lower layer II is exemplified by 80 mm. The width of folded sheets 30 of the upper layer I and the width of folded sheets 20 of the lower layer II are W0 in the second direction of the stack of folded sheets.

As is the case with the shown embodiment set forth above, the width W5 is also preferably 40 to 90% of the width W2. Furthermore, the upper layer I comprises at least two folded sheets, preferably three folded sheets or more, or more preferably five folded sheets or more. The upper layer I preferably comprises ten folded sheets 30 or less, or the ratio of the number of the folded sheets 30 of the upper layer I to the sum of the number of the folded sheets 30 of the upper layer I and the number of the folded sheets 20 of the lower layer II is preferably one half or less, or more preferably one third or less.

If the width of each of the overlap portions L, L1 and L2 in which the sheets are joined to each other is less than the preferable range of 30±20 mm, the upper portion of the underlying sheet fails to protrude sufficiently from the dispensing opening 42 when the overlying sheet is withdrawn from the dispensing opening 42. On the other hand, if the defined range is exceeded, the upper portion of the underlying sheet protrudes excessively from the dispensing opening 42 so that the sheet is easily dried. The width of the dispensing opening 42 is preferably 40 mm or less, or more preferably 30 mm or less.

In the embodiments shown in FIGS. 3, 4 and 5, the width W1, W4 and W5 of the upper layer I are respectively smaller than the width W2 of the lower layer II. Accordingly, when each sheet 11 of the upper layer I is withdrawn from the dispensing opening 42, it is subjected to the lower resistance applied by the peripheral edge of the dispensing opening 42 so that each sheet can be smoothly taken out. After all the sheets 11 of the upper layer I were withdrawn, the clearance is left between the top surface 41 of the container 40 and the lower layer II, that is, the uppermost sheet of the lower layer II is positioned away from the top surface 41 of the container 40. Accordingly, after withdrawal of all the sheets of the upper layer I, the resistance to be applied by the peripheral edge of the dispensing opening 42 will not be increased even if the width W2 of the lower layer II is relatively large.

As a result, all the folded sheets 11 of the upper and lower layers are pulled out while being properly subjected to the resistance. When the overlying sheet is taken out from the pop-up type package, the underlying sheet interfolded via the overlap portion L, L1 or L2 is lifted and drawn to present the upper portion thereof in the readily accessible location above the dispensing opening 42. Then, the underlying sheet can be pulled out by grasping (or pinching) the upper portion thereof. The resistance is properly applied by the peripheral edge of the dispensing opening 42 to the sheets of both the upper layer I and the lower layer II, as set forth above, so that it is possible to reliably stably present the upper portion of the underlying sheet in the accessible location above the dispensing opening 42.

On the other hand, it eliminates the need for enlarging the width of the dispensing opening 42 so that the packaged sheets can be prevented from being dried. Furthermore, the width W2 of the lower layer II can be made large (or increased) so that the stack of sheets and the container 40 can be prevented from being vertically elongated to reduce the height of the sheet package, and to make it excellent in portability and installation. In other words, it is possible to obtain the sheet package having conveniently portable size.

Furthermore, in manufacturing process of the sheet package, it is unnecessary to previously leave the clearance between the stack of sheets and the top surface 41 in the container. Accordingly, it is possible to simplify the process of packaging the stack of sheets with the container 40 such as the soft package sheet in order to form the sheet package, for example.

In the case where the sheets 11 are water-decomposable, on the other hand, the breaking strength in the pulling-out direction of the folded sheets (i.e., in the direction of withdrawing the folded sheets) will be reduced when the sheets are in the wet state. However, the resistance to be applied by the peripheral edge of the dispensing opening 42 is not increased (i.e., not excessive) so that the sheets 11 of the upper layer I are not broken when being taken out. In particular, if the upper and bottom top portions of each sheet of the upper layer I are two-folded or double as in the embodiment shown in FIG. 5, it is possible to increase the breaking strength in the pulling-out direction and improve an effect of avoiding breakage of the sheets, even if the sheets are water-decomposable. In the shown embodiment of FIG. 5, furthermore, each doubled end or two-folded portion about the fold line 31 is located under the dispensing opening 42 to facilitate pinching the doubled end by the fingers of the user so that the water-decomposable sheets can be prevented from being broken by the fingers. In the shown embodiment of FIG. 3, each doubled end or two-folded portion about the fold line 17 is also located under the dispensing opening 42 to facilitate pinching the doubled end by the fingers so that the withdrawal force of the fingers can be increased.

The sheets may be water-decomposable (or degradable) sheets of which the fibers are broken and dispersed in water when they are, after used, disposed of in flush toilets and have received a large amount of water therein. For example, they include paper or nonwoven fabrics made of fibers such as rayon or pulp and containing a water-degradable or water-swellable binder such as CMC (carboxymethyl cellulose); nonwoven fabrics of rayon fibers or the like having a fiber length of at most 10 mm or at most 7 mm and having been subjected to water-jetting treatment for entangling the fibers, of which the entangled fibers having such a short length of at most 10 mm are, when having received a large amount of water, unentangled and degraded in water; and paper or nonwoven fabrics of rayon or pulp that contains fibrillated rayon, in which the fibrillated rayon serves as a binder.

These water-decomposable sheets have such wet breaking strength of not more than 4.9 N or not more than 2.45 N per a width of 25 mm of the sheet, in the direction of withdrawing the sheets out of the dispensing opening 42. When the sheet package of the invention is employed, it is possible to prevent the sheets from being broken upon dispsensing the sheets even if these sheets have such low breaking strength.

The sample to be tested was cut into pieces each having a width of 25 mm and a length of 150 mm, and wetted with water to have a water content of 2.5 times its dry weight. These were tested by use of a Tensilon tester, for which the chuck distance was 100 mm and the stress rate was 100 mm/min. The strength at break (N) of the sample thus measured indicates the wet tensile strength (or tension load) thereof.

In the invention, the individual sheets of the stack of sheets may be water-decomposable sheets in a wet state, water-decomposable sheets in a dry state, or water-undecomposable sheets in a wet or dry state.

Furthermore, the stack of folded sheets of the invention may be a three-layer structure including the upper layer I, the lower layer II, and an intermediate layer located between the upper layer I and the lower layer II. Specifically, the intermediate layer has a larger width than that of the upper layer I, and the lower layer II has a larger width than that of the intermediate layer. Alternatively, the width of the stack of folded sheets may be made gradually larger stepwise or continuously from the upper layer I toward the lower layer II to define the stack of folded sheets of the invention.

As set forth above, the sheet package according to the invention can reduce the resistance to be applied by the peripheral edge of the dispensing opening of the container when dispensing the sheets located in the upper layer. After all the sheets of the upper layer were taken out, on the other hand, the clearance (or the space) is left between the dispensing opening and the sheets of the lower layer. Accordingly, the resistance to be applied upon withdrawing the sheets will not be increased even if the sheets of the lower layer have a larger width (i.e., as-folded width). As a result, it is possible to smoothly take out the sheets and to prevent the breakage of even the sheets having low breaking strength.

Although the present invention has been illustrated and described with respect to exemplary embodiment thereof, it should be understood by those skilled in the art that the foregoing and various other changes, omission and additions may be made therein and thereto, without departing from the spirit and scope of the present invention. Therefore, the present invention should not be understood as limited to the specific embodiment set out above but to include all possible embodiments which can be embodied within a scope encompassed and equivalent thereof with respect to the feature set out in the appended claims.

What is claimed is:

1. A sheet package comprising:

a stack of sheets including a plurality of sheets folded about fold lines and arranged in a vertically stacked configuration;

a receptacle for containing said stack of sheets, said receptacle made of hard or soft material and having a dispensing opening in a top surface thereof;

said stack of sheets including an upper layer of a plurality of sheets located in the vicinity of said dispensing opening, and a lower layer of a plurality of sheets located under said upper layer; and the width of said upper layer being smaller than that of said lower layer in a direction perpendicular to the fold lines of the sheets.

2. The sheet package as set forth in claim 1, the width of said upper layer is substantially equal to the width of said lower layer in a direction parallel to the fold lines of the sheets.

3. The sheet package as set forth in claim 1, wherein clearances are left on both sides of said upper layer within said receptacle.

4. The sheet package as set forth in claim 1, wherein the individual sheets are wet sheets moistened with water or a solution.

5. The sheet package as set forth in claim 4, wherein the individual sheets are water-decomposable sheets having a wet breaking strength of 4.9 N or less per a width of 25 mm in the direction perpendicular to the fold lines of the sheets.

6. The sheet package as set forth in claim 1, wherein the individual sheets are folded to define a top flap portion and a bottom flap portion, and interfolded in such a manner that the top flap portion of an underlying sheet lies on the bottom flap portion of an overlying sheet so as to protrude a portion of the underlying sheet from said dispensing opening when the overlying sheet is withdrawn.

7. The sheet package as set forth in claim 1, wherein the number of times of folding the sheets located in said upper layer is larger than the number of times of folding the sheets located in said lower layer.

8. The sheet package as set forth in claim 1, wherein the number of the sheets of said upper layer is not less than two, and the number of the sheets of said upper layer is one half or less of a total of the sheets of said upper layer and said lower layer.

9. The sheet package as set forth in claim 1, wherein the width of said upper layer is 40 to 90% of the width of said lower layer in the direction perpendicular to the fold lines of the sheets.

* * * * *